US006511299B1

(12) United States Patent
Shinokubo et al.

(10) Patent No.: US 6,511,299 B1
(45) Date of Patent: Jan. 28, 2003

(54) FAN IN WHICH MOTOR YOKE IS MOUNTED BY CAULKING OR SPOT WELDING AND THE MOUNTING METHOD THEREOF

(75) Inventors: Kiyoshi Shinokubo, Kitasaku-gun (JP); Shoichi Takei, Kitasaku-gun (JP)

(73) Assignee: Minebea Co., Ltd., Kitasaku (JP)

( * ) Notice: Subject to any disclaimer, the term of this patent is extended or adjusted under 35 U.S.C. 154(b) by 86 days.

(21) Appl. No.: 09/694,006

(22) Filed: Oct. 23, 2000

(30) Foreign Application Priority Data

Apr. 19, 2000 (JP) ..... 2000-117889

(51) Int. Cl.[7] ..... F04B 17/00

(52) U.S. Cl. ..... 417/354; 417/423.12; 417/423.1; 29/522.1

(58) Field of Search ..... 417/423.12, 423.1, 417/354; 29/522.1

(56) References Cited

U.S. PATENT DOCUMENTS 4,620,139 A * 10/1986 Egami et al. ..... 318/254
4,861,237 A * 8/1989 Shiraki et al. ..... 417/353
4,959,571 A 9/1990 Yasumoto et al. ..... 310/67 R
5,519,270 A * 5/1996 Yamada et al. ..... 310/67
5,847,485 A * 12/1998 Suzuki et al. ..... 310/257
6,050,785 A * 4/2000 Horng ..... 417/354
6,249,505 B1 * 6/2001 Miyamoto et al. ..... 369/266

FOREIGN PATENT DOCUMENTS

DE 3 144 447 A1 7/1982
EP 0 310 391 4/1989

* cited by examiner

*Primary Examiner*—Charles G. Freay
*Assistant Examiner*—William Rodriguez
(74) *Attorney, Agent, or Firm*—Oliff & Berridge, PLC

(57) ABSTRACT

A fan in which, on one end of the motor shaft 6 a stepped portion 19 having a small diameter is formed, on which a central portion of the motor yoke 11 is press-fitted and fixed by caulking, thereby the motor yoke is mounted directly on the shaft 6. By such a structure, the conventional boss between the shaft 6 and the motor yoke 11 can be omitted and the structure can be simplified.

2 Claims, 5 Drawing Sheets

FAN IN WHICH MOTOR YOKE IS MOUNTED BY CAULKING OR SPOT WELDING AND THE MOUNTING METHOD THEREOF

BACKGROUND OF THE INVENTION

1. Field of the Invention

The present invention relates to the improvement of a fan and a motor yoke mounting method for a fan to be used in the O.A. (Office automation) equipment of various types.

2. Description of the Related Art

O.A. equipment of various types accommodates a large number of electronic circuits in its housing, so that the heat generated by electronic components forming those electronic circuits is difficult to be expelled therefrom, and some electronic components may be broken or deteriorated. In particular, in the recent tendency of miniaturizing such O.A. equipment, the equipment is miniaturized without considerable reduction of the generated heat, and accordingly the countermeasure against heat is required as an important technical solution. Therefore, a ventilating hole is provided on the side wall of the equipment and a fan is fixed therein to expel the internal heat out of the equipment, thereby eliminating the thermal damage occurred inside.

An example of a fan of this type which has been conventionally and widely used will be described with reference to FIG. 9 Reference numeral 1 designates a casing that has a cylindrical shape. A housing 2 is integrally formed to a central portion of this casing 1. A cylindrical bearing liner 3 is fitted in a central portion of the housing 2. Outer races of bearings 4 and 5 are supported on the inner side of this bearing liner 3, and inner races of the bearings 4 and 5 support a shaft 6 having an equal diameter at two axial locations. A ring 7 is mounted on a lower end of the shaft 6 to prevent removal of the shaft 6 as well as to position the shaft 6 axially.

Reference numeral 8 designates an impeller that is made of synthetic resin to have blades 10 on the outer periphery of the main body 9. The main body 9 of this impeller 8 is fitted onto a cup-shaped motor yoke 11. The motor yoke 11 is fitted to the upper end of the shaft 6 through a zinc-die-casting boss 12. Further, the upper end of the shaft 6 is formed with a knurl 13 to enhance the adhesion of the boss 12 thereto when the boss 12 molded. An annular magnet 14 is adhesively fixed to an inner periphery of the motor yoke 11 to form a rotary section.

A stator iron core 16 on which a stator winding 15 is provided is disposed on the outer side of bearing liner 3 and fixed to the bearing liner 3 to form a stator section. A PC board 17 which forms an electronic circuit as a brush-less motor with electronic components is mounted on the lower portion of the stator iron core 16. The electronic circuit incorporated in this PC board 17 controls current supplied to rotate the rotary section relative to the stator section. A lead wire not shown, connects the stator winding 15 to the electronic circuit incorporated in the PC board 17. A lead wire 18 is connected to the PC board 17 to supply electric power to the PC board 17.

The fan of such construction is used by being mounted on a ventilating hole of the housing of the O.A. equipment. The fan is mounted in such a manner as the upper portion thereof in FIG. 9 is directed outward the housing of the O.A. equipment and so that the shaft 6 extends horizontally. Under this state, when a power source is connected to the lead wire 18 to supply a predetermined voltage thereto, the current controlled by the control circuit in the PC board 17 flows to the stator winding 15, so that the rotary section is rotated by a magnetic interaction between a magnetic flux caused on the stator iron core 16 and a magnetic flux generated by the magnet 14. The rotation of the impeller 8 absorbs the air inside the housing in the lower side of the drawing, to direct and expel the air out of the housing into the direction which is indicated as upward in the drawing. This air ventilation cools the interior of the housing.

The aforementioned conventional fan has such a complicated construction that the motor yoke 11 is mounted on the shaft 6 through the boss 12 made by zinc-die-casting, and thus there was a tendency that the motor yoke 11 was mounted under inconstant force. In particular, when the motor components are miniaturized, because of such complicated mounting structure, there was such a problem that the mounting force of the motor 11 was not stabilized. Furthermore, there was a problem that the zinc-die-casting causes a cost increase.

SUMMARY OF THE INVENTION

The present invention has been made in the light of the above problems. Accordingly, an object of the present invention is to provide a fan in which a motor yoke can be mounted on a shaft with a simple construction and securely, and a mounting force of the motor yoke can be stabilized, in particular when the motor components are miniaturized, and also, a reduction of the manufacturing cost can be achieved.

An means for achieving the above-mentioned object, according to a first aspect of the present invention, in a fan in which a bearing is disposed on a central portion of a cylindrical casing, a motor yoke is mounted on a shaft supported by the bearing, and a stator iron core is disposed inside the motor yoke. The fan device is characterized in that a stepped portion defining a smaller diameter on an end face side is provided on one end portion of the shaft; and the motor yoke is mounted to the shaft portion in such a manner that the central portion of the motor yoke is fitted to the stepped portion by press-fitting, and the motor yoke thus fitted by the press-fitting is fixed to the stepped portion by caulking, thereby completing the mounting of the motor yoke on the shaft.

And, according to a second aspect of the present invention, a bearing is disposed on a central portion of a cylindrical casing, a motor yoke is mounted to a shaft supported by the bearing, and a stator iron core is disposed inside the motor yoke. The fan is characterized in that the shaft has an equal diameter on one end portion thereof and the motor yoke is mounted on the shaft in such a manner as the central portion of the motor yoke is fitted to the one end portion by press-fitting, and the motor yoke thus fitted by press-fitting is fixed to the one end portion by spot welding thereby the mounting of the motor yoke to the shaft is completed.

With the structure described in each claim, the shaft can be directly mounted on the central portion of the motor yoke without using the boss made by zinc-die-casting as in the conventional style. Consequently, it is possible to obtain a fan that is simple in construction, stable in strength, and low in cost.

DESCRIPTION OF THE PREFERRED EMBODIMENT

Figure 1:
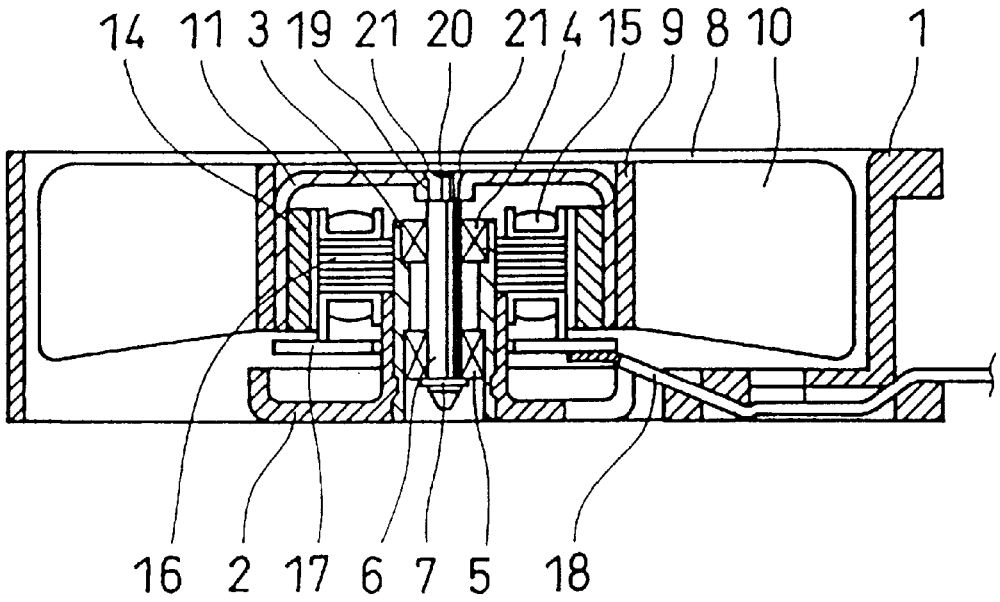
FIG. 1 is a longitudinally sectional view showing a fan according to an embodiment of the present invention.

An embodiment of the present invention will be described with reference to FIG. 1. Reference numeral 1 designates a casing that has a cylindrical shape. A housing 2 is formed integrally with a central portion of this casing 1. A cylindrical bearing liner 3 is fitted in a central portion of the housing 2. Outer races of bearings 4 and 5 are supported on the inner side of the bearing liner 3, and inner races of the bearings 4 and 5 support a shaft 6 at two points. A ring 7 is mounted on a lower end of the shaft 6 to prevent the shaft 6 from pulling out and to position the shaft 6 in an axial direction.

Figure 2:
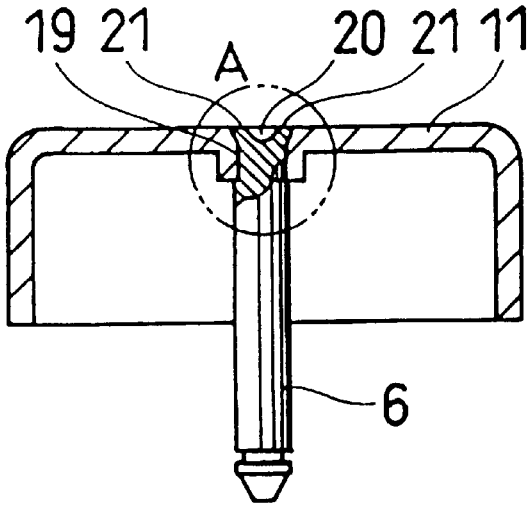
FIG. 2 is a sectional view showing major portion in connecting a shaft to a motor yoke In the fan of FIG. 1.
Figure 3:
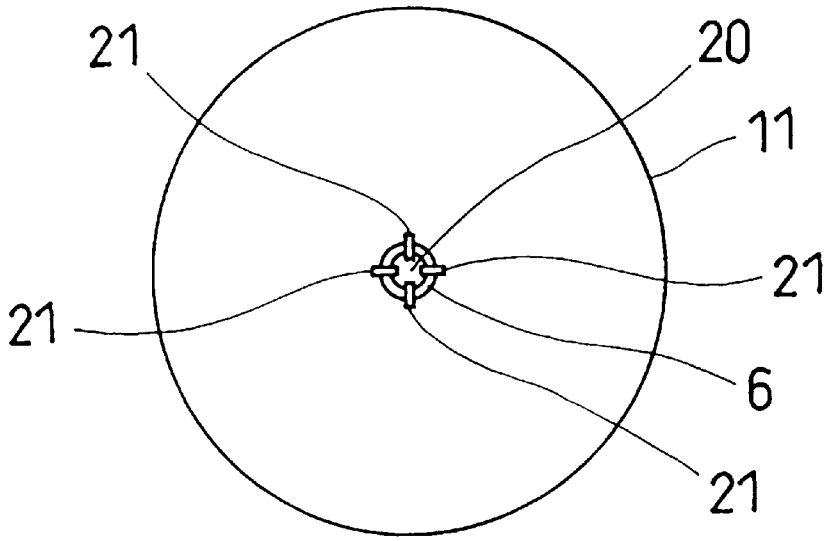
FIG. 3 is a plan view showing the major portion.

Reference numeral 8 designates an impeller that is made of synthetic resin to have a cylindrical main body 9 and blades 10 on the outer periphery of the main body 9. The main body 9 of this impeller 8 is fitted and fixed on an outer periphery of a cup-shaped motor yoke 11. As shown in a portion A in FIG. 2 and FIG. 3, the shaft 6 is directly inserted and fitted to a central portion of this motor yoke 11.

Figure 4:
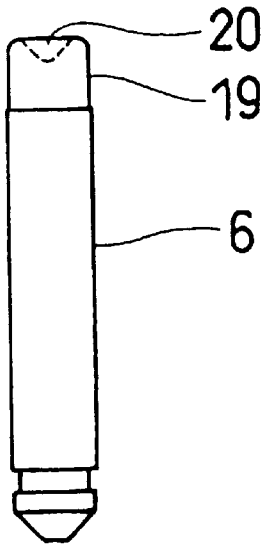
FIG. 4 is an enlarged view solely showing the shaft before being mounted to the motor yoke as shown In FIG. 2.

As shown enlarged in FIG. 4 the shaft 6 is formed at the upper end of FIG. 4 in a stepped portion 19 defining a slightly smaller diameter. Furthermore, the shaft 6 is provided with a funnel-shaped recess 20 in the central portion of the upper end face.

The motor yoke 11 is then mounted on the stepped portion 19 of the shaft 6 in such a manner as the central portion of the above motor yoke 11 is fitted by press-fitting, and the pressure-fitted motor yoke 11 is fixed to the above stepped portion 19 by caulking thereby, the mounting of the motor yoke 11 on the shaft 6 is completed.

Here the tip end (i.e. the lower end in FIGS. 2 and 4) of the above recess 20 is coincident in location with a central axis of the shaft 6, and the shape of the recess 20 is symmetric with respect to the central axis, so that this recess 20 is used for a guide and centering at the time of fixing by caulking. In addition, every reference numeral 21 in the drawings denotes caulking fixed portions. Although fixing portions 21 by caulking are shown here in 4 portions, then may be anyway in plural number if they can be set so as to prevent the central axis of the shaft 6 from being shifted.

In FIG. 1, an annular magnet 14 is fixed in adhesion to an inner periphery of the above motor yoke 11 to form a rotary section. A stator iron core 16 on which a stator winding 15 is provided is disposed on the outer side of the bearing liner 3 and fixed thereto to form a stator section. Mounted on the lower portion of the stator iron core 16 is a PC board 17 which forms an electronic circuit as a brush-less motor by electronic components. The electronic circuit incorporated in this PC board 17 controls current supplied to rotate the rotary section relative to the stator section. A lead wire not shown, connects the stator winding 15 to the electronic circuit incorporated in the PC board 17. Furthermore, a lead wire 18 is connected to the PC board 17 to supply electric power to the PC board 17.

Figure 5:
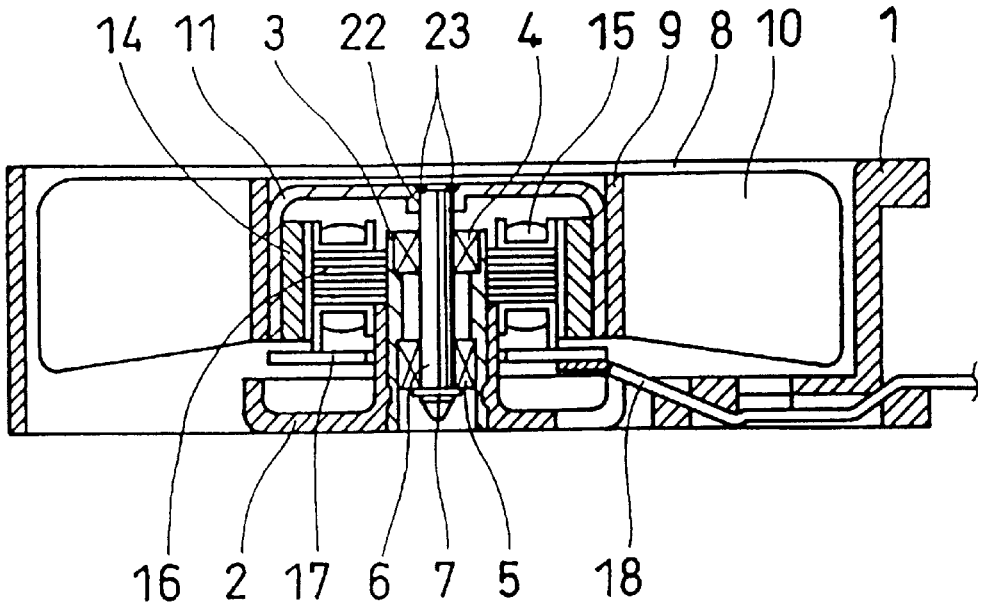
FIG. 5 is a longitudinally sectional view showing a fan according to another embodiment of the present invention.

Next, another embodiment of the present invention will be described with reference to FIG. 5. Here, components as same as or corresponding to those described with reference to FIG. 1 are designated by the same reference numerals. so that repeated description therefor is omitted. Therefore, the following discussion is mainly focused on a difference from the embodiment shown in FIG. 1.

Figure 6:
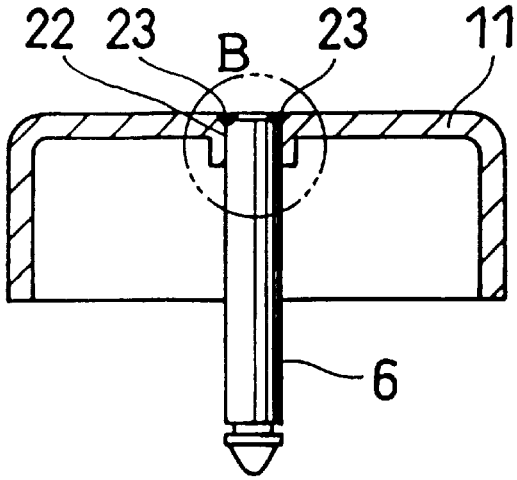
FIG. 6 is a sectional view showing major portions in connecting a shaft to a motor yoke In the device of FIG. 5.
Figure 7:
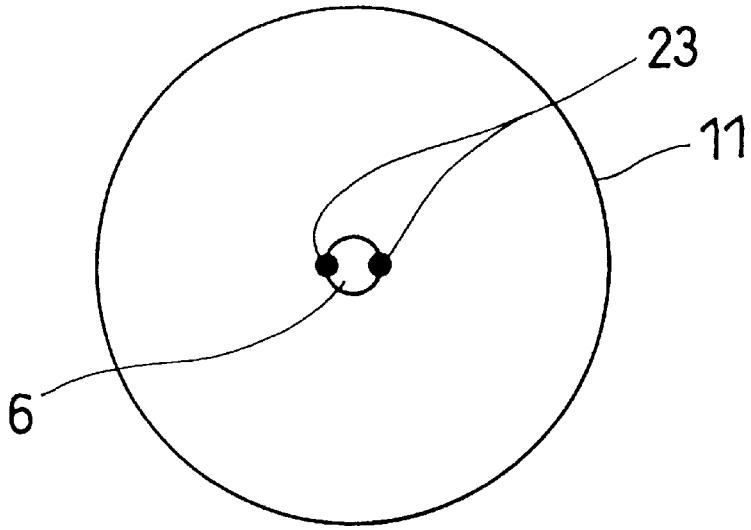
FIG. 7 is a plan view showing the major portion.

In this embodiment, as shown in a portion B of FIG. 6 and FIG. 7, the shaft 6 is directly inserted and fitted to the central portion of the motor yoke 11.

Figure 8:
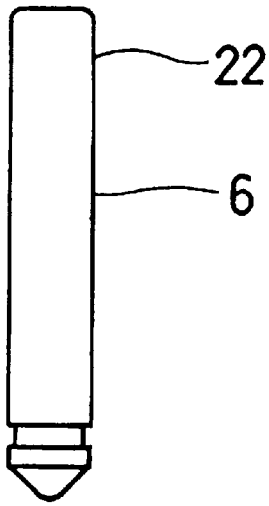
FIG. 8 is an enlarged view solely showing the shaft before being mounted to the motor yoke as shown In FIG. 6.
Figure 9:
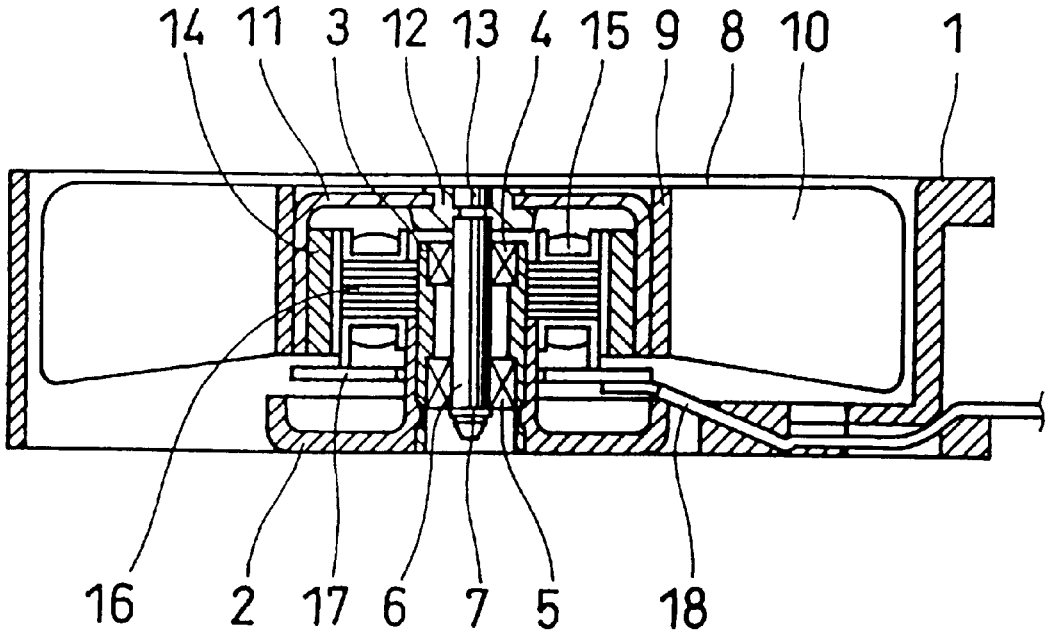
FIG. 9 (Prior Art)
FIG. 9 is a longitudinally sectional view showing a conventional fan.

Here, as shown enlarged in FIG. 8, an upper end portion 22 of the shaft 6 is dimensioned to have an equal diameter. The motor yoke 11 is mounted on the shaft 6 in such a manner that the motor yoke 11 is press-fitted to the upper end portion 22 of the shaft 6 thus constructed, and then the press-fitted motor yoke 11 is fixed to the upper end portion 22 by spot welding. In addition, reference numeral 23 designates each one of the fixed portions by spot welding.

The fan described above is of an axial flow fan motor type, but the present invention should not be limited thereto and can be widely applied to a blower and so on.

According to the present invention, since a shaft is directly press-fitted to the central portion of a motor yoke, the boss made by zinc-die-casting which was used conventionally, becomes unnecessary.

For this reason, it is possible to stably mount the motor yoke or the impeller integrated with the motor yoke or the like onto the shaft with a simple construction. In particular, when the motor components are miniaturized, the mounting force of the motor yoke and impeller to the shaft can be effectively stabilized. Moreover, the cost can be reduced by not using the boss made by zinc-casting.

What is claimed is:

1. A motor yoke mounting method of a fan in which a pair of bearings are disposed on a central portion of a cylindrical casing, a motor yoke mounted on a shaft supported by the bearing and a stator iron core disposed inside the motor yoke, comprises the steps of:

forming a stepped portion of smaller diameter on an end face side of the shaft;

press-fitting the motor yoke at the central portion to the stepped portion; and fixing the motor yoke on the stepped portion by caulking.

2. A motor yoke mounting method of a fan in which a pair of bearings are disposed on a central portion of a cylindrical casing, a motor yoke mounted on a shaft supported by the bearings and a stator iron core disposed inside the motor yoke, comprises the steps of:

press-fitting the motor yoke at the central portion to one end of the shaft; and fixing the motor yoke on the end of the shaft by spot welding.

* * * * *